United States Patent [19]

Shimada et al.

[11] Patent Number: 4,710,041

[45] Date of Patent: Dec. 1, 1987

[54] HEAT-TRANSFER THERMAL RECORDING DEVICE

[75] Inventors: Mitsuhiro Shimada; Junichiro Matsumoto, both of Nara; Susumu Nonaka, Yamatokoriyama; Haruo Sayama, Nara, all of Japan

[73] Assignee: Sharp Kabushiki Kaisha, Osaka, Japan

[21] Appl. No.: 31,178

[22] Filed: Mar. 26, 1987

Related U.S. Application Data

[63] Continuation of Ser. No. 790,520, Oct. 23, 1985, abandoned.

[30] Foreign Application Priority Data

Oct. 23, 1984 [JP] Japan ..... 59-223478
Oct. 26, 1984 [JP] Japan ..... 59-226449

[51] Int. Cl.[4] ..... B41J 3/02

[52] U.S. Cl. ..... 400/120; 400/207; 400/618; 400/621; 400/622; 346/76 PH

[58] Field of Search ..... 400/120, 201, 207, 636, 400/636.1, 617, 618, 621, 622; 346/76 PH; 219/216 PH

[56] References Cited

U.S. PATENT DOCUMENTS

| | | | |
|---|---|---|---|
| 4,388,628 | 6/1983 | Moriguchi | 346/76 PH |
| 4,532,524 | 7/1985 | Yan et al. | 346/76 PH |
| 4,534,666 | 8/1985 | Watanabe | 400/207 |
| 4,542,997 | 9/1985 | Matsushima | 400/201 X |
| 4,552,470 | 11/1985 | Yana et al. | 400/120 |
| 4,562,443 | 12/1985 | Matsuno et al. | 346/76 PH |
| 4,562,444 | 12/1985 | Nagashima | 400/120 X |

FOREIGN PATENT DOCUMENTS

| | | | |
|---|---|---|---|
| 3425953 | 1/1985 | Fed. Rep. of Germany | 400/120 |
| 11261 | 1/1984 | Japan | 400/120 |
| 159370 | 9/1984 | Japan | 400/120 |
| 171662 | 9/1984 | Japan | 400/120 |
| 2117708 | 10/1983 | United Kingdom | 400/120 |

*Primary Examiner*—Eugene H. Eickholt
*Attorney, Agent, or Firm*—Birch, Stewart, Kolasch & Birch

[57] ABSTRACT

Disclosed is a heat-transfer type thermal recording device capable of recording/printing color pictures by heating an ink tape using a thermal line head and transferring ink from the ink film tape to a continuous sheet of recording paper where the ink film tape and recording paper are conveyed simultaneously, consisting of a vertical cassette unit with an ink-tape supply reel and a take-up reel which allows both to freely rotate by suspending them between two side panels of the cassette unit, with such a configuration in which the ink tape from the supply reel is continuously retrieved by the take-up reel through an inferior aperture in the cassette unit after the ink tape is drawn through a superior aperture in the cassette unit. The cassette unit is installed in a designated position inside the thermal recording device to enable easy loading and unloading and to simplify positioning of the ink film tape between the thermal line head of the recording device and the recording paper platen reel.

9 Claims, 4 Drawing Figures

HEAT-TRANSFER THERMAL RECORDING DEVICE

This application is a continuation of application Ser. No. 790,520, filed on Oct. 23, 1985, and now abandoned.

BACKGROUND OF THE INVENTION

The present invention relates to a heat-transfer type thermal recording device which heats an ink film tape with a thermal head to soften the ink enabling transfer of the ink onto recording paper. Specifically, the present invention relates to a cassette device containing an ink film tape for use in a line-format thermal recording device and the specific paper-feeding method employed in such a line-format thermal recording device.

Recently, a wide variety of compact-size and low-cost color hard copying machines including heat-transfer type thermal recording devices have been developed. These heat-transfer type thermal recording devices first heat the ink film tape, softening the ink to enable transfer onto standard recording paper. Ink is printed on each picture by overlapping a variety of colors in the order of yellow (Y), magenta (M), cyan (C), and black (B) in a method conventionally called the "sequential picture coloration system".

In conventional machines, the ink film tape which contains yellow (Y), magenta (M), cyan (C), and black (B) colors in sequence moves forward while the paper must move backward and forward to allow the sequential printing of each color overlapping them to achieve the desired final shade.

One of the prior art devices featuring the above mechanism is the configuration shown in FIG. 3 and described below. Reference number 31 indicates the drive roller, which is connected to the drive source via drive pulley 32 and provided with teeth 31A, each being engaged with perforations 33A and 33B on either side of the recording paper. The recording paper 33 is conveyed from a paper-feeding sprocket 34, which rotates in synchronism by pulley with the drive roller 31, and passes under the drive roller 31 and then over its upper side. The supply reel 35 is loaded with the ink film tape 36. After being drawn from the supply reel 35, the ink film tape 36 passes between the recording paper 33 and the drive roller 31 before being wound onto the take-up reel 37 which is connected to the drive motor 38. A line-format thermal head 39 is installed in a position below the drive roller 31. The thermal head 39 is pressed against the recording paper 33 on the drive roller 31 during the recoding operation. This causes the ink to soften and be transferred onto the recording paper 33. These conventional thermal recording devices require complex operations prior to printing, namely the ink film tape wound on the supply reel needs to be drawn from this reel and passed through the drive roller and thermal head before it is retrieved on the take-up reel. The operations of loading and unloading the ink film tape are unnecessarily complicated; furthermore, the tape is easily creased or damaged during these operations.

When operating the conventional thermal recording device shown in FIG. 3, the following process must be followed. The recording paper 33 moves forward and backward according to the rotation of drive roller 31 and by means of edge perforations 33A and 33B and teeth 31A and 31B. Power is provided to drive roller 31 through drive pulley 32. The recording paper 33 is conveyed from the paper-feeding sprocket 31 which rotates in synchronism by pulley with the drive roller 31, passes under the driver roller 31 and to its upper side. The ink film tape 36, simultaneously drawn from the supply roller 35, passes through the drive roller 31 along a path below the recording paper 33 and is then wound onto the take-up reel 37 which is connected to the drive motor 38. In addition, the line-format thermal head 39 is installed in a position below and close to the drive roller 31. The thermal head 39 is pressed against the recording paper 33 on the drive roller 31 while the recording operation is underway, thus causing the ink to soften and to be adequately transferred onto the recording paper 33. To successfully print using this conventional thermal recording device, the recording paper 33 must move back and forth three or four times, so that the colors are applied in sequence, overlapping yellow (Y), magenta (M), cyan (C), and black (B) until the desired shade is achieved. If the recording paper 33 is not fed through rollers precisely, unwanted shades and imprecise delineation of color on the recording paper 33 will result. When operating a thermal recording device capable of printing with a discrimination of 10 dots per millimeter as a line-format device to print successive colors, only +0.05 mm of color deviation per dot is permissible without poor quality printing. Even though conventional tractor-feed format type machines are effective against paper skewing, they are not able to feed the recording paper with the precision necessary for printing successive colors due to employing a recording paper clamping mechanism. Conventional machines, other than tractor-format types, employ platen rollers, but these machines have problems such as skewing or slippage of recording paper, and are thus unable to feed paper with the precision necessary to print successive colors.

SUMMARY OF THE INVENTION

The present invention consists of a thermal recording device employing easily-replacable ink film tapes and a color-picture recording device which prevents slippage of the recording paper even during the repeated back-and-forth motion necessary to print colors in sequence. This device both simplifies the conventional ink film roller system and prevents recording paper slippage to ensure precise color printing.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those who are skilled in the art from the following detailed description.

The preferred embodiments of the present invention provide a unique heat-transfer type thermal recording device capable of printing color pictures by heating the ink film tape using a thermal-line head and transferring ink from the ink film tape to the recording paper. The ink film tape and recording paper are conveyed simultaneously. The heat-transfer type thermal recording device is comprised of a vertical cassette unit consisting of an ink-take supply reel and a take-up reel. These reels are suspended between side-panels in such a manner so as to allow free rotation of both. The ink tape exiting from the supply reel through a superior aperture is continuously retrieved by the take-up reel through an inferior aperture after printing. The ink cassette is installed in a designated position inside the thermal recording device to enable easy loading and unloading and to simplify positioning of the ink tape between the thermal line head of the recording device and the recording paper platen reel.

Another preferred embodiment of the present invention provides a unique paper-feeding unit, as part of a color-picture recording device, which is capable of feeding the recording paper by rotating a paper drum. The paper drum is connected to the drive source while the recording operation is underway and implements the recording-paper feeding operation in the reverse direction by reversing the rotation of both the platen and paper-feeding roller. It is comprised of the following: a platen roller connected to the drive source, a paper-feeding roller in contact with the platen roller, a thermal line head which comes into contact with and moves away from the platen roller, a rotary drum in a position close to the platen roller and connected to the drive source, a recording-paper clamping mechanism provided in a circumferential position with respect to the rotary drum, a recording paper held on its leading edge by the clamping mechanism of the rotary drum, following pasage between both the platen roller and the thermal line head, by means of the platen roller and paper-feed roller, and an ink tape that transfers ink onto the recording paper, wherein the ink tape travels between said plate roller and thermal line head with the recording paper interposed between the ink type and the platen roller.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 1:
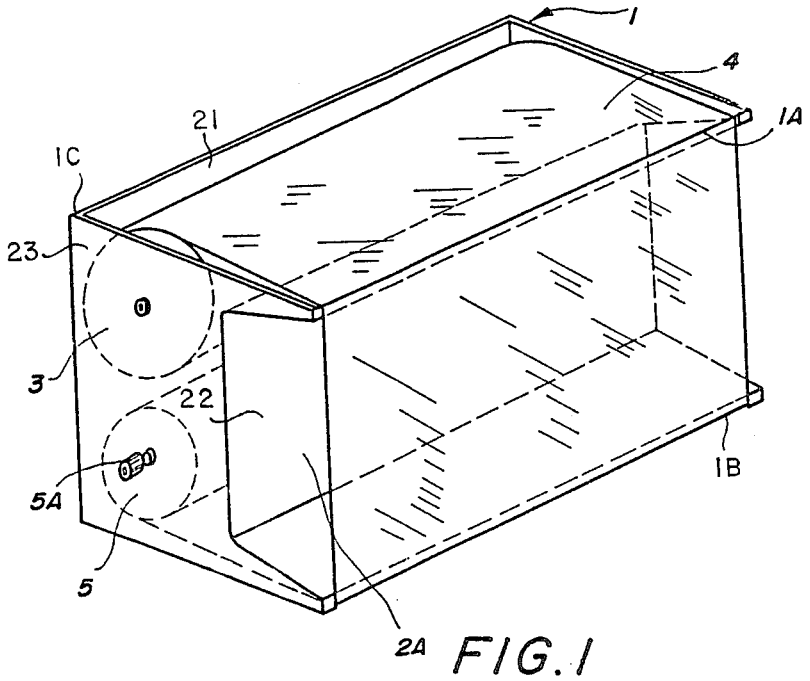
FIG. 1 is a perspective view of the cassette unit containing an ink film tape used in the above-mentioned thermal recording device and showing one of the preferred embodiments of the present invention.
Figure 3:
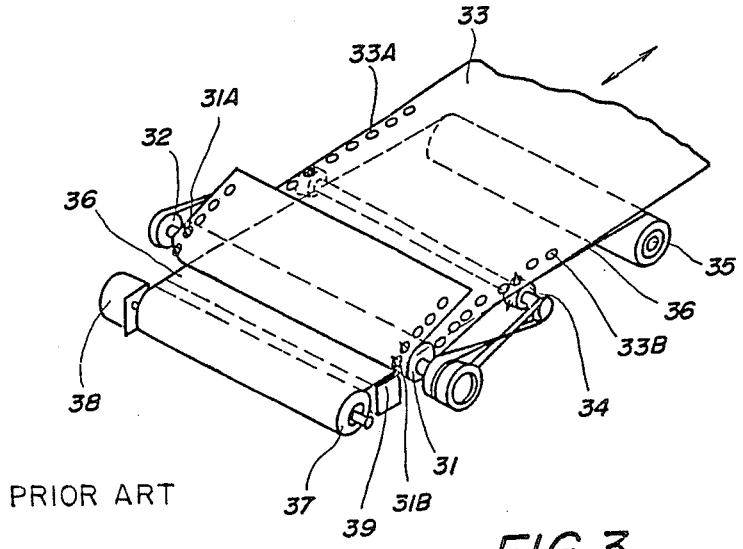
PRIOR ART FIG. 3
FIG. 3 is a conventional recording device.

Referring now to FIG. 1 there is seen the ink tape cassette unit 1 comprising a case 1C consisting of a continuous rear panel 21, a concave, U-shaped continuous front panel 22, and side panels 23. Superior aperture or slit 1A and inferior aperture or slit 1B are formed in the upper and lower front edges of the U-shaped front panel, respectively. A supply reel 3 is wound with the ink film tape 4 which is set in the upper interior of the cassette unit 1. The supply reel 3 is suspended at both ends of a rotary shaft from the side panels 23 of ink tape cassette unit 1 so that it can both freely rotate and be freely loaded and unloaded. The ink film tape 4 stores various colors in order of yellow (Y), magenta (M), cyan (C), and black (B) in an array. A take-up reel 5 is installed below the supply reel 3. Like supply reel 3, both ends of a rotary shaft of the take-up reel are supported by both side panels 23 of the cassette unit 1 so that the take-up reel 5 can freely rotate and be freely loaded and unloaded. One end of the take-up reel 5 is provided with a connector 5A comprised of gears, which projects from a side panel of the cassette unit 1 to connect the latter to an external drive source (not shown). The ink film tape 4 wound on the supply reel 3 is drawn out of the superior aperture 1A, traverses in a downward direction before the front panel 22 and retrieved by the take-up reel 5 through the inferior aperture 1B. Note that, as described below, the line-format thermal head is capable of being positioned in a space 2A formed by the concave portion of the U-shaped front panel 22.

Figure 2:
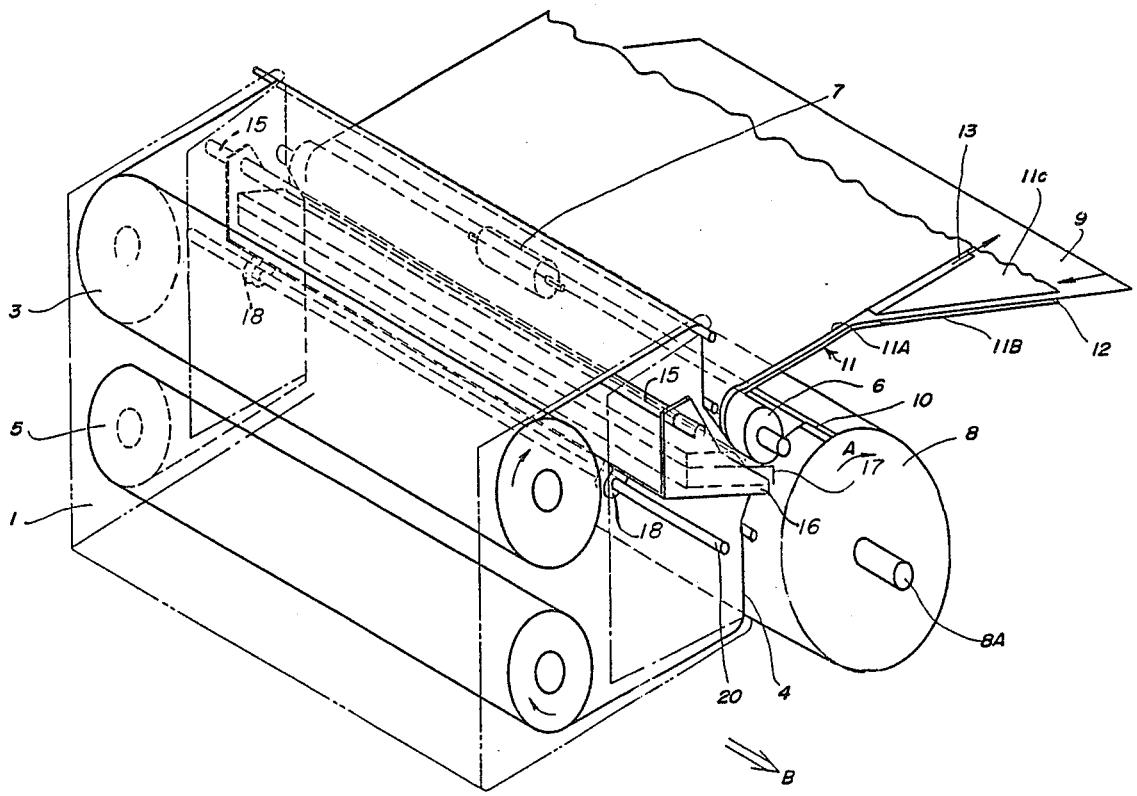
FIG. 2 is a schematic perspective representation of the recording device loaded with the cassette unit shown in FIG. 1.

FIG. 2 is a schematic representation of the thermal recording device loaded with the ink tape cassette unit 1. In FIG. 2, a platen roller 6 is connected to a drive source (not shown). A paper-feed roller 7 is provided which comes into contact with the circumferential surface of the platen roller 6. A paper-feeding drum 8 is installed in a position slightly below the platen roller 6, and the rotary shaft 8A is connected to a drive source. A paper clamp 10 is provided for gripping the leading edge of a recording paper 9 located in a position on the surface of the paper-feed drum 8. Guide unit 11 leads the recording paper 9 to a designated position between the platen roller 6 and the paper-feed roller 7, which is comprised of the upper guide plate 11A and the lower guide plate 11B as well as a V-shaped member 11C which divides the inlet and outlet of the recording paper 9. Consequently, the recording paper 9 is inserted into the recording device through the lower inlet 12 and then conveyed between the platen roller 6 and the paper-feed roller 7 by means of the upper and lower guide plates 11A and 11B. Since the front edge of the upper guide plate 11A is bent downward to meet the upper part of the platen roller 6 in a manner following the curvature of the platen roller 6, the recording paper 9 advanced by both the platen roller 6 and the paper-feeding roller 7 is then oriented downward before coming into contact with the surface of the paper-feeding drum 8. Then, the leading edge of the recording paper 9 becomes attached to the circumferential surface of the paper-feed drum 8 by the paper clamp 10 of the drum 8. The paper-feed drum 8 is rotated in the direction of the arrow A during the recording operation and winds the recording paper 9 onto its circumferential surface. After completing the recording operation, the recording paper 9 is removed from the paper-feed drum 8 via the upper outer 13 by reversing the rotation of both the platen roller 6 and the paper-feed roller 7.

The cassette unit 1 shown in the schematic representation of FIG. 2 is installed in such a manner so that it is opposite from the position of guide unit 11 with respect to the paper-feed drum 8.

The ink film tape 4 as it is drawn to traverse through the space 2A in front of the cassette unit 1 thereby approaches the platen roller 6.

In FIG. 2, the cassette unit 1 is shown by broken lines. Shaft 15 is installed in parallel with the platen roller 6 inside the space 2A formed by the concave portion of the front panel 2 of the cassette unit 1. Both ends of the shaft 15 are supported by frames (not shown) on either side of space 2A. In addition, a support angle 16, on which the thermal line head 17 rests, is attached to the shaft 15, so that it can freely rotate. The thermal line head 17 is installed on support angle 16, and by the counterclockwise rotation of support angle 16, the recorder part of thermal head 17 can be pressed against the surface of the platen roller 6, the ink film take 4 passing between the thermal head 17 and the platen roller 6. When support angle 16 rotates clockwise, the recorder part of the thermal line head 17 moves away from the platen roller 6. The thermal line head 17 is held by several braces 18 which are installed below the support angle 16. These braces 18 are located on the drive shaft 20 at specific intervals. The drive shaft 20 is supported by the above referenced side frames, while one end of the drive shaft 20 is connected to a drive source (not shown) which causes the drive shaft 20 to rotate either clockwise or counterclockwise in response to a signal from the controller unit (not shown) of the recording device. As a result, the thermal line head 17 can either come into contact with the ink film tape at the circumferential surface of the platen roller 6 during the recording operation or move away from it, making the thermal head inoperative.

Loading and unloading of the cassette unit 1 from the thermal recording device are described below. To replace the ink film tape 4, the thermal line head 17 must be set to an inoperative position, removed from contact with the platen roller 6. Then one of the pair of frames provided on either side of space 2A (supporting both shaft 15 and drive shaft 20) is removed from the thermal recording device. In other words, the near side frame in FIG. 2 is removed. As a result, both shaft 15 and drive shaft 20 are left supported only by a far-side frame member. Only the cassette unit 1, shown in FIG. 1, can be withdrawn in the direction of the B, and it is then replaced with a new ink film tape. The cassette unit 1 is reinstalled in the thermal recording device by reversing the above mentioned procedure.

Those operations needed for recording pictures with the thermal recording device embodied by the present invention are described below.

First the recording paper 9 is directed by guide unit 11 so that the leading edge of the paper can be fed through and between the platen roller 6 and the paper-feed roller 7. Then the leading edge of the recording paper 9 is brought in contact with the circumferential surface of the paper-feed drum 8 by operating rollers 6 and 7 before the leading edge is clamped by paper-clamp 10 of the drum 8. Now, the continuous recording paper 9 is directed onto the paper-feeding drum 8 through the inlet path 12 of guide unit 11. The recording paper 9 is set to an initially designated position. Before actually starting with the recording operation, the thermal line head 17 is set to a recording activation position. Now, the thermal line head 17 is pressed against the platen roller 6 with the ink film tape 4 and the recording paper 9 in between. Actually, one picture area is recorded by the thermal line head 17 with one rotation of the paper-feed drum 8 in the direction of arrow A. Simultaneously, the ink film tape 4 moves forward and is then retrieved by take-up reel 5. Yellow (Y) is applied to one picture area of the recording paper first. After completing this initial recording operation for one picture area, the paper-feed drum 8 is brought to a standstill. The thermal line head 17 is then set to its inoperative position. The recording device then reverses the rotation of both the platen roller 6 and the paper-feed roller 7 moving the recording paper 9 back to its initial or starting position. Meanwhile, the paper-feed drum 8 rotates in a direction opposite to that of the arrow A. As soon as the recording paper 9 returns to its initial position, the recording device stops the rotation of both the platen roller 6 and the paper-feed roller 7 in order to execute the recording of the next color designated. The thermal line head 17 is then replaced in the recording activation position and the paper-feed drum 8 rotates again in the direction of the arrow A. The thermal recording device embodied by the present invention then repeats the operation described above to record magenta (M), cyan (C), and black (B) on the recording paper 9 in that order. For reproducing desired shades, these basic colors (including yellow and the three other colors) overlap to eventually cover each picture area. After completing all of the designated operations for recording these colors, the thermal recording device deactivates the thermal line head 17 by removing it from the recording position. The thermal recording device then cuts the recording paper to allow removal of the picture-recorded paper from the paper-feed drum 8. This recorded paper will eventually be discharged from outlet 13 by means of the platen roller 6 and the paper-feed roller 7.

As is clear from the above detailed description, the heat-transfer type thermal recording device using the line-format thermal head, reflecting one of the preferred embodiments of the present invention, far exceeds conventional models of a similar nature. The vertical cassette unit includes ink tape supply and take-up reels which can freely rotate between side panels, allowing the ink tape from the supply reel to be drawn out of the superior aperture and to be retrieved by a take-up reel through the inferior aperture. In addition, the present thermal recording device allows the cassette unit to be freely loaded into and removed from the recording device to enable easy replacement of the ink tape.

Figure 4:
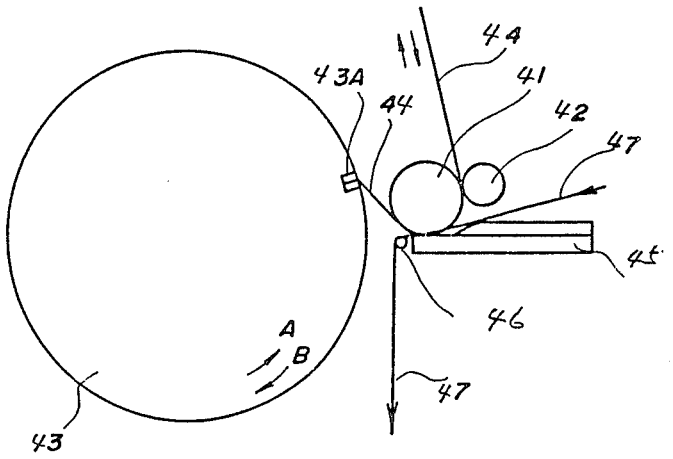
FIG. 4 represents a recording device which reflects another preferred embodiment of the present invention.

FIG. 4 is a simplified diagram of the configuration of main components of the heat-transfer type thermal recording device which reflects another preferred embodiment of the present invention. A platen roller 41 is connected to the drive source (not shown). A paper-feed roller 42 is provided in contact with the platen roller 41. The rotary drum 43 is provided close to and in parallel with the platen roller 41. The rotary drum 43 connected to a drive source (not shown) takes up the recording paper 44 fed between the platen roller 41 and the paper-feed roller 42. The circumferential surface of the rotary drum 43 is provided with a paper clamp 43A that holds the leading edge of the recording paper 44 to the circumferential surface. The line-format thermal head 45 is designed to come into contact with and leave the platen roller 41 from the lower position of the roller. After being fed between the platen roller 41 and the paper-feed roller 42, the recording paper 44 passes through the thermal head 45 located below the platen roller 41 and is then conveyed to the circumferential surface of the rotary drum 43 via a guide roller 46. The leading edge of the recording paper 44 is held by paper clamp 43A and then the recording paper 44 is sequentially wound onto the circumferential surface of the rotary drum 43 in the direction of the arrow A. The diameter of the rotary drum 43 is designed so that the drum 43 can be covered by one picture area of recording paper 44. The ink film tape 47 is drawn out of a supply reel (not shown) and passes through a space between the platen roller 41 and the thermal head 45 located below the recording paper 44 before eventually being wound onto a take-up reel (not shown) located at a lower position by way of the guide roller 46. The ink film tape 47 contains yellow (Y), magenta (M), cyan (C) and black (B) colors in a sequential array according to each picture area unit, and this tape moves in one direction while the recording operation is underway.

Operations of the above system are described below.

When setting the recording paper 44 in position, the thermal head 45 is not in contact with the circumferential surface of the platen roller 41. The recording paper 44 passes between the platen roller 41 and the paper-feed roller 42 so that the lead edge of the recording paper passes through the bottom of the platen roller 41 and is then caught in the paper clamp 43. Rotary drum 43 is at this time in the initial position shown in FIG. 4. After the recording paper 44 is in position, the ink film tape 47 is set into motion. Then, the thermal head 45 is pressed against the platen roller 41 with the ink film tape 47 and the recording paper 44 in between to start the recording operation. During the recording operation, the rotary drum 43 is simultaneously rotated in the direction of the arrow A so that recording of one picture area can be performed on the recording paper 44. At the same time, the ink film tape 47 also moves forward. During the recording operation, the platen roller 41 rotates idle or just enough to maintain tension in the recording paper 44. After completing the recording of one picture area by applying a single color, yellow for example, the system first stops the rotary drum 43, causing the thermal head 45 to leave the platen roller, releasing pressure from the recording paper 44 and the ink film tape 47. The rotary drum 43 stands still while the platen roller 41 is rotated so that it reverses the paper-feeding direction. Thus, the recording paper 44 returns to its initial position. The device then sets the ink film tape 47 to the position where the next color, magenta for example, is contained. As soon as the recording paper 44 returns to its starting position the platen roller 41 and the rotary drum 43 also stop their rotation at their initial positions. When the recording paper 44 is brought back to the initial-printing start-up position, the rotary drum 43 may also be rotated in the direction of arrow B up to the initially set position at a speed equivalent to the platen roller 41. Thus, as soon as the recording paper 44 has been fully returned to the initial-printing start-up position, the recording device then causes the thermal head 45 to come in contact with the platen roller 41, with the ink film tape 47 and the recording paper 44 in between, to resume the same recording operations described above. These operations are performed in sequence to record desired shades and pictures on the recording paper by overlapping the basic colors yellow, magenta, cyan, and black on each picture area. After completing all of the recording operations, the recording device then releases the paper clamp 43A of the rotary drum 43 to remove the recorded papers 44 from the rotary drum 43 before eventually discharging the recorded papers.

As is clear from the foregoing detailed description, the heat-transfer type thermal recording device reflecting another preferred embodiment of the present invention is comprised of a variety of unique functions and component members. This multiple-color recording device first heats the ink film tape by means of the thermal head, then transfers the ink to the recording paper causing the various colors to be overlapped in sequence on each picture area. The multiple-color recording device is comprised of the following: a platen roller connected to a drive source a paper-feed roller in contact with the platen roller, a thermal line head that comes into contact with and leaves the platen roller, a rotary drum provided in a position close to the platen roller and connected to a drive source, a recording-paper clamping unit located on the rotary drum, color-picture recording paper that passes between the platen roller and the paper-feed roller, the tip-end of which is attached to the drum by the clamp, and an ink film tape containing various color ink. The heat-transfer type thermal recording device performs the paper feeding operation by rotating the rotary drum during the recording operation. The recording paper is fed in the opposite direction by means of the platen roller and the paper-feed roller. Consequently, even though the recording paper is repeatedly moved back and forth no slippage results. This provides high-precision paper-feeding throughout the repeated forward and backward movements. Thus, the present heat-transfer type thermal recording device can securely prevent color deviation from occurring, a problem encountered when using conventional recording devices. It is thus possible for the system to produce an extremely satisfactory pictures from multiple-color recording.

While only certain embodiments of the present invention have been described, it will be apparent to those who are skilled in the art that various changes and modifications may be made therein without departing from the spirit and scope of the present invention as claimed herein.

What is claimed is:

1. A vertical cassette unit for use in combination with a heat-transfer thermal recording device for recording/printing color pictures by selective heating of multi-colored segmented ink film tape on color picture recording paper by a thermal line head consisting of:

a case having a continuous rear panel, a concave, U-shaped continuous front panel, two side panels shaped so as to conform to the U-shaped configuration of said front panel and superior and inferior apertures formed in upper and lower front edges of said U-shaped front panel, respectively;

ink film tape supply reel rotatably mounted at both ends thereof by a rotary shaft on said side panels in an upper rear interior portion of said case;

ink film take-up reel rotatably mounted at both ends thereof by a rotary shaft on said side panels in a lower rear portion of said case below said supply reel, one end of said take-up reel being provided with a gear connector which protects from a corresponding side panel to be connected to a drive source; and a multi-colored segmented ink film tape in the form of a continuous sheet having two end portions wound on said supply reel and take-up reel, each of said two end portions being engaged by said respective supply reel and take-up reel, said ink film tape traversing from said supply reel to said take-up reel via said superior and inferior apertures in front of said U-shaped front panel forming a space between said ink film tape and said front panel such that a thermal line head may be rotatably installed in said space laterally between both sides of said cassette unit, parallel to said continuous sheet of said ink film tape.

2. The vertical cassette unit of claim 1, further including a shaft positioned in parallel with said continuous ink film tape and said supply and take-up reels, inside said space formed between the concave portion of said U-shaped front panel and said ink film tape, and a support angle member for support of said thermal line head rotatably attached to said shaft.

3. A heat transfer thermal recording device for recording color pictures on a continuous sheet of color picture recording paper comprising:

a continuous color picture recording paper for recording color pictures thereon, a reversible platen roller having a circumferential surface rotatably supported in said thermal transfer recording device to transport said continuous recording paper within said recording device in a first direction, paper feed drum juxtapositioned in a rotatably supported manner below said platen roller having a clamp on the surface thereof for gripping a lead edge of said recording paper during recording of said color picture on said recording paper;

paper feed roller having a surface which is in contact with said circumferential surface of said platen roller, for advancing said continuous recording paper to an initial position on the surface of said paper-feed drum, platen roller drive means for driving said reversible platen roller in said first direction to affix said lead edge of said recording paper to said paper feed drum by said surface clamp, and in a reverse direction, a guide unit which directs said recording paper to a position between said platen roller and paper-feed roller in a direction opposite to the direction of rotation of said paper-feed drum during recording of said color picture on said recording paper;

a thermal line head freely rotatably supported in said thermal transfer recording device juxtapositioned to said platen roller;

an ink tape cassette unit including a multicolor ink film tape rotatably supported opposite said guide unit and paper feed drum such that said ink film tape approaches said platen roller between said platen roller and said thermal line head;

thermal line head moving means for selectively rotating said thermal line head in either a counter clockwise rotation during the recording operation or in a clockwise direction when not recording, so that when rotating in said counter clockwise direction said thermal line head is pressed against said platen roller with said ink film tape and recording paper sandwiched in between for thermally transferring colored ink from said ink film tape to said recording paper and when rotated in said clockwise direction said thermal line head moves away from said platen roller to interrupt said recording; and paper feed drum drive means for rotating said feed drum during said picture recording operation in a direction opposite to said first direction of rotation of said platen roller, synchronously with the rotation of said multicolor ink film tape, said platen roller drive means transporting said recording paper in said first direction synchronously with the rotation of said ink film tape, said paper feed roller being brought to a standstill when said recording operation is completed whereby said recording device reverses the rotation of said platen roller and said paper feed roller so as to reverse said paper feed direction and return said recording paper to said initial position, said paper feed roller also rotating in said reverse direction, at which time said recording device stops rotation of both said platen roller and said paper-feed roller and repeats said image recording so as to complete the recording of said color pictures.

4. The heat-transfer thermal recording device of claim 3, wherein said paper feed drum applies tension to said recording paper during recording of said color picture thereby eliminating recording paper slippage and providing high precision recording paper feeding throughout repeated forward and backward movement.

5. The heat-transfer thermal recording device of claim 3, wherein said guide unit comprises an upper guide plate, lower guide plate and a V-shaped member which divides said upper and lower guide plates at a first end for establishing an inlet and outlet for said recording paper.

6. The heat-transfer thermal recording device of claim 5, wherein a front edge of said upper guide plate at a second end is bent downward toward said circumferential surface of said platen roller in a manner following the curvature of said platen roller so as to direct said lead edge of said recording paper downward towards the surface of said paper feed drum.

7. The heat-transfer thermal recording device of claim 3, further including means for cutting said recording paper to allow removal of said completed color picture.

8. The heat-transfer thermal recording device of claim 3, wherein said ink tape cassette unit comprises:

a case having a continuous rear panel, a concave, U-shaped continuous front panel, two side panels shaped so as to conform to the U-shaped configuration of said front panel and superior and inferior apertures formed in upper and lower front edges of said U-shaped front panel, respectively;

ink film tape supply reel rotatably mounted at both ends thereof by a rotary shaft on said side panels in an upper rear interior portion of said case;

ink film take-up reel rotatably mounted at both ends thereof by a rotary shaft on said side panels in a lower rear portion of said case below said supply reel, one end of said take-up reel being provided with a gear connector which projects from a corresponding side panel to be connected to a drive source; and a multi-colored segmented ink film tape in the form of a continuous sheet having two end portions would on said supply reel and take-up reel, each of said two end portions being engaged by said respective supply reel and take-up reel, said ink film tape traversing from said supply reel to said take-up reel via said superior and inferior apertures in front of said U-shaped front panel forming a space between said ink film tape and said front panel such that a thermal line head may be rotatably installed in said space laterally between both sides of said cassette unit, parallel to said continuous sheet of said ink film tape.

9. The heat-transfer thermal recording device of claim 8, wherein said ink tape cassette unit further includes a shaft positioned in parallel with said continuous ink film tape and said supply and take-up reels, inside said space formed between the concave portion of said U-shaped front panel and said ink film tape, and a support angle member for support of said thermal line head rotatably attached to said shaft.

* * * * *